US007874620B2

(12) United States Patent
Kooistra et al.

(10) Patent No.: US 7,874,620 B2
(45) Date of Patent: Jan. 25, 2011

(54) HEALTH CARE CHAIR

(75) Inventors: Brett W. Kooistra, Grand Haven, MI (US); Benjamin B. Edinger, Grand Haven, MI (US); David Ritch, Venice, CA (US); Mark Saffell, Manhattan Beach, CA (US); Gary L. Cruce, Seattle, WA (US); David E. Simon, Bainbridge Island, WA (US); Todd Ireland, Coopersville, MI (US)

(73) Assignee: Herman Miller, Inc., Zeeland, MI (US)

( * ) Notice: Subject to any disclaimer, the term of this patent is extended or adjusted under 35 U.S.C. 154(b) by 299 days.

(21) Appl. No.: 12/080,804

(22) Filed: Apr. 4, 2008

(65) Prior Publication Data

US 2009/0250979 A1 Oct. 8, 2009

(51) Int. Cl.
*A47C 1/00* (2006.01)

(52) U.S. Cl. ..... 297/326; 297/344.15; 297/344.16

(58) Field of Classification Search ..... 297/344.14, 297/344.15, 344.16, 326, 327
See application file for complete search history.

(56) References Cited

U.S. PATENT DOCUMENTS

| | | | | |
|---|---|---|---|---|
| 869,122 | A | 10/1907 | Witte | |
| 974,769 | A | 11/1910 | Hoff | |
| 1,025,915 | A | 5/1912 | Hoff | |
| 2,365,200 | A | 12/1944 | Lorenz | |
| 2,539,034 | A | 1/1951 | Ruby | |
| 3,158,398 | A | 11/1964 | Stryker | |
| 4,466,664 | A | 8/1984 | Kondou | |
| 4,632,455 | A | 12/1986 | Schiller et al. | |
| 4,690,457 | A | 9/1987 | Poncy et al. | |
| 4,752,100 | A | 6/1988 | Lemaire | |
| 4,828,323 | A | 5/1989 | Brodersen et al. | |
| 4,902,072 | A | 2/1990 | Chancellor, Jr. | |
| 4,969,686 | A | 11/1990 | Germain | |
| 4,979,726 | A | 12/1990 | Geraci | |
| 5,011,224 | A | 4/1991 | Paul | |
| 5,217,276 | A | 6/1993 | LaPointe et al. | |
| 5,292,170 | A | 3/1994 | LaPointe et al. | |
| 5,383,709 | A * | 1/1995 | Chaney et al. | 297/327 |
| 5,503,453 | A | 4/1996 | Saul et al. | |
| 6,467,847 | B2 | 10/2002 | Bidare | |
| 7,000,988 | B2 * | 2/2006 | Bressler et al. | 297/344.16 X |
| 7,008,016 | B1 * | 3/2006 | Carlo | 297/281 |
| 7,455,360 | B2 * | 11/2008 | White et al. | 297/344.14 |

* cited by examiner

*Primary Examiner*—Anthony D Barfield
(74) *Attorney, Agent, or Firm*—Brinks Hofer Gilson & Lione

(57) ABSTRACT

A health care chair includes a base and a seating portion attached to the base. A lift assist mechanism connects the base and seating portion and assists in moving the seating portion from a first reclined position to a second inclined position without electrical power. The chair also includes moveable arms attached to the seating portion that rotate between a first substantially horizontal position and a second substantially vertical position.

25 Claims, 6 Drawing Sheets

10
26
14
18
24
42
A
38
40
41
B
30
C
16
20
22

HEALTH CARE CHAIR

TECHNICAL FIELD

The disclosed embodiments relate generally to a health care chair. More specifically, the present subject matter relates to chair that transitions between a first position and a second inclined position using an over-center locking mechanism to prevent unwanted movement between positions and that has pivoting arms that lock in first and second positions.

BACKGROUND

The health care industry is preparing for an increase in care required for the aging baby-boom generation. In addition to the baby-boomers, there is also a trend towards obesity in health care industry patients. As a result, there is a demand for useful health care furniture that can support the weight of obese patients without taking up critical floor space. Of critical importance are hospital room chairs as it has been shown that the more time a patient spends in a chair, rather than a bed, the speedier the recovery.

Existing chairs used in health care facilities tend to be bulky, get in the way of caregivers and are hard to move around the room, for example to clean. Further, existing reclining or angled chairs are difficult for patients to get out of and for caregivers to assist patients out of. There are problems both with the seat angles as well as the arms interfering with caregiver's assistance. Lift assist chairs often require a power source which limits the movability of the chair.

The chair covering is important for cleaning as well as to prevent the user from sticking to or slipping on the chair. Existing cloth covered chairs are often difficult to clean and existing vinyl covered chairs are often sticky and slippery. Additionally, current chair coverings typically do not provide for adequate air flow and dispersion of pressure across the seating contact surfaces.

Therefore, there exists a clear need for a chair with a functional covering, moveable arms, tiltability and reclinability without electrical power, a small footprint and stable structure that is portable when empty and stable when occupied.

SUMMARY

The above and other needs are met by the disclosed embodiments which provide a chair with a functional covering, moveable arms, tiltability and reclinability without electrical power, a small footprint and stable structure that is portable when empty and stable when occupied.

In one example, the disclosed embodiments solve these problems and meet these objectives, at least in part, by utilizing a chair including a base and a seating portion attached to the base. A lift assist mechanism connects the base and seating portion and assists in moving the seating portion from a first reclined position to a second inclined position without electrical power. The chair also includes moveable arms attached to the seating portion that rotate between a first substantially horizontal position and a second substantially vertical position and that lock in each of the first and second positions.

In another example, the disclosed embodiments solve these problems and meet these objectives, at least in part, by utilizing a chair including a seating portion adjustable between two positions, including a first reclined position and a second inclined position and an over-center locking mechanism including a spring loaded or air powered activator that locks when the seating portion is in the first reclined position and assists in moving the seating portion to the second inclined position.

In yet another example, the disclosed embodiments solve these problems and meet these objectives, at least in part, by utilizing a chair including a seating portion adjustable between an approximately ten degree reclined position and an approximately three degree inclined position. The chair also includes an activator that biases the seating portion towards the inclined position and movable arms attached to the seating portion that rotate between a first substantially horizontal position and a second substantially vertical position.

Additional objects, advantages and novel features of the examples will be set forth in part in the description which follows, and in part will become apparent to those skilled in the art upon examination of the following description and, the accompanying drawings or may be learned by production or operation of the examples. The objects and advantages of the concepts may be realized and attained by means of the methodologies, instrumentalities and combinations particularly pointed out in the appended claims.

BRIEF DESCRIPTION OF THE DRAWINGS

The drawing FIGS. depict one or more implementations in accord with the present concepts, by way of example only, not by way of limitations. In the FIGS., like reference numerals refer to the same or similar elements.

DETAILED DESCRIPTION OF THE PREFERRED EMBODIMENTS

It is contemplated that the subject matter described herein may be embodied in many forms. Accordingly, the embodiments described in detail below are the presently preferred embodiments, and are not to be considered limitations.

Figure 2:
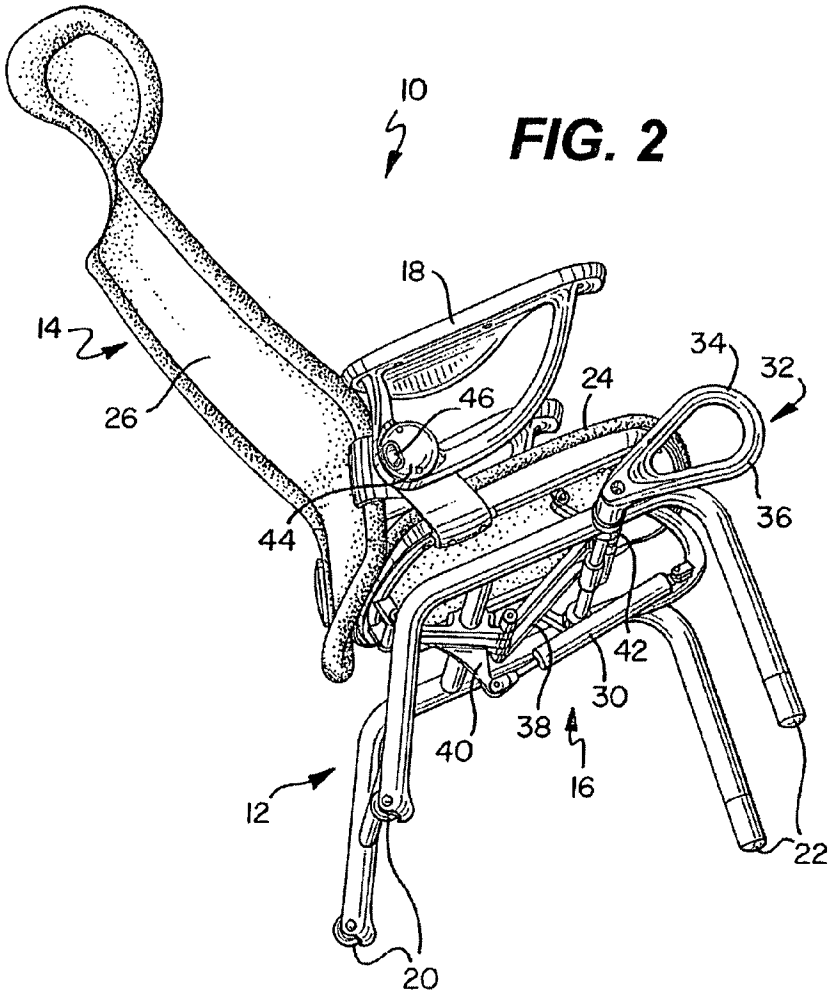
FIG. 2 is a bottom side perspective view of the chair shown in FIG. 1.
Figure 1:
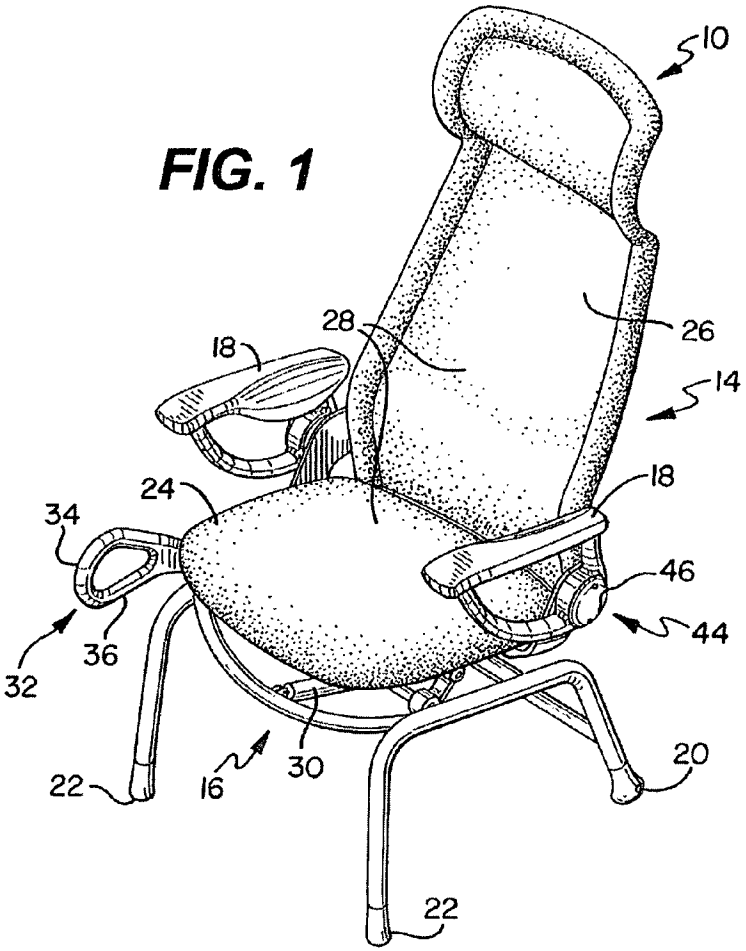
FIG. 1 is a top side perspective view of a chair of the present invention.

Referring now to the FIGS., and specifically to FIG. 1, a chair 10 is illustrated. As shown in FIG. 1, the chair 10 includes a base 12, an inclining and reclining seating portion 14, a lift assist mechanism 16 and adjustable arms 18. The base 12 shown in FIG. 1 is a standard four legged chair base, however, it is understood that the base 12 may be any type of chair base, using any number of legs or other support members in any configuration that provides support for the inclining seat portion 14 and the lift assist mechanism 16, as further described herein. As further illustrated in the example shown in FIG. 1, the base 12 may include castors 20 on any of the legs, or other support members, to enable ease of relocating the chair 10. For example, with castors 20 on the two back legs, the chair 10 is easily movable when empty. The base 12 may also include stoppers 22 or brakes (not shown) or any other mechanism useful in preventing movement of the chair 10 in use. Further, the base 12 may be formed from any structurally appropriate material, such as, for example, woods, metals, plastics, etc. In the example shown in FIG. 1, the base 12 is constructed primarily from aluminum.

As further shown in FIG. 1, the seating portion 14 is supported by the base 12 through the lift assist mechanism 16. As shown in FIG. 1, the seating portion 14 includes a seat 24 and a back 26. In one embodiment the angle between the seat 24 and the back 26 is fixed. Accordingly, the seat 24 and back 26 work together to form a seating portion, in this case, an inclining and reclining seating portion 14. The seating portion 14 includes appropriate bracing and other structural support to enable the seating portion 14 to support a person sitting in the chair. The seating portion 14 shown in FIG. 1 also includes appropriate materials that increase the comfort level of the chair in use. For example, in the example shown in FIG. 1, the seating portion 14 includes a seating surface 28 and a back surface that is a mesh/knit textile constructed of a polyurethane based elastic monofilament warp fiber supporting a polyester yarn weft fiber. Accordingly, the seating surface 28 is a breathable fabric that is preferably non-slip and is easily cleaned. However, it is contemplated that any materials and design appropriate for supporting a user may be incorporated into the seating portion 14.

An example of the lift assist mechanism 16 is shown in FIGS. 2 and 5-8 to illustrate the various components. In the example shown, the lift assist mechanism 16 includes a spring 30 assisting an over-center locking control lever 32 that is used to reposition the chair 10 between a first "sitting" position (as shown in FIGS. 1-3, 5 and 7) and a second "inclined" position (and shown in FIGS. 4, 6 and 8).

Although the lift assist mechanism 16 shown in FIGS. 1-8 is merely one example of a lift assist mechanism 16 that may be employed to meet the needs and provide the solutions described herein, this lift assist mechanism 16 is the presently preferred embodiment of the multitude of contemplated lift assist mechanisms 16. For example, although the spring 30 shown is a gas spring 30, it is contemplated that any number of types of springs, actuators or other mechanisms or energy sources, including those that provide resistance in opposition to compression may be used in place. Similarly, the inclusion or exclusion and orientation of the various members described below or additional members that may be utilized, the direction and degrees of rotation, the location of the lift assist mechanisms 16 with respect to the base 12 and seating portion 14 shown in and described in reference to FIGS. 1-8 may be altered without departing from the solutions provided herein. For example, in the example shown, the sitting position is reclined at approximately ten degrees from horizontal and the inclined position is inclined at approximately three degrees from the horizontal. However, it is understood that these angles are merely one example and a variety of ranges may be utilized with departing from the scope of the solutions provided herein.

As shown, the lift assist mechanism 16 illustrated in the FIGS. includes a control lever 32. The control lever 32 shown in the Figs. includes a rotating handle 34 that provides a gripping portion 36 that is easy for a user to grasp regardless of the position of the handle 34. As shown, this handle 34 includes a looped gripping portion 36 for ease of grasping the handle 34. Rotation of the control lever 32 manipulates a four bar linkage mechanism including a rear cross bar 37, an over-center locking arm 38 and a front cross bar 39. In the mechanism, rotation of the handle 34 rotates a mounting bar 41 around the front cross-bar 39, which in turn moves the over-center locking arm 38 as will be described further herein.

Figure 7:
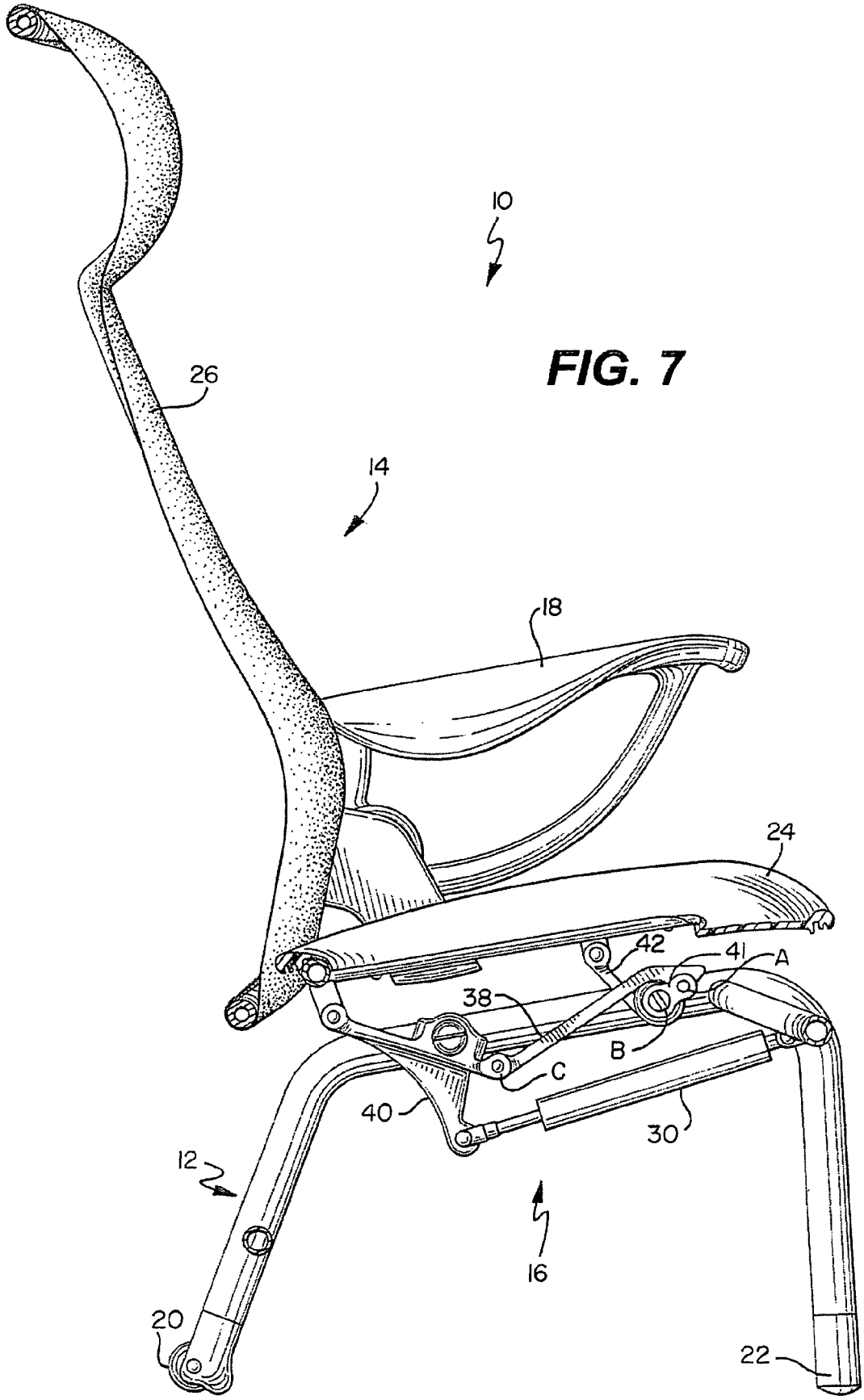
FIG. 7 is a cross-section side view of the chair shown in FIG. 1, wherein the seat is in the first position shown in FIG. 3.
Figure 8:
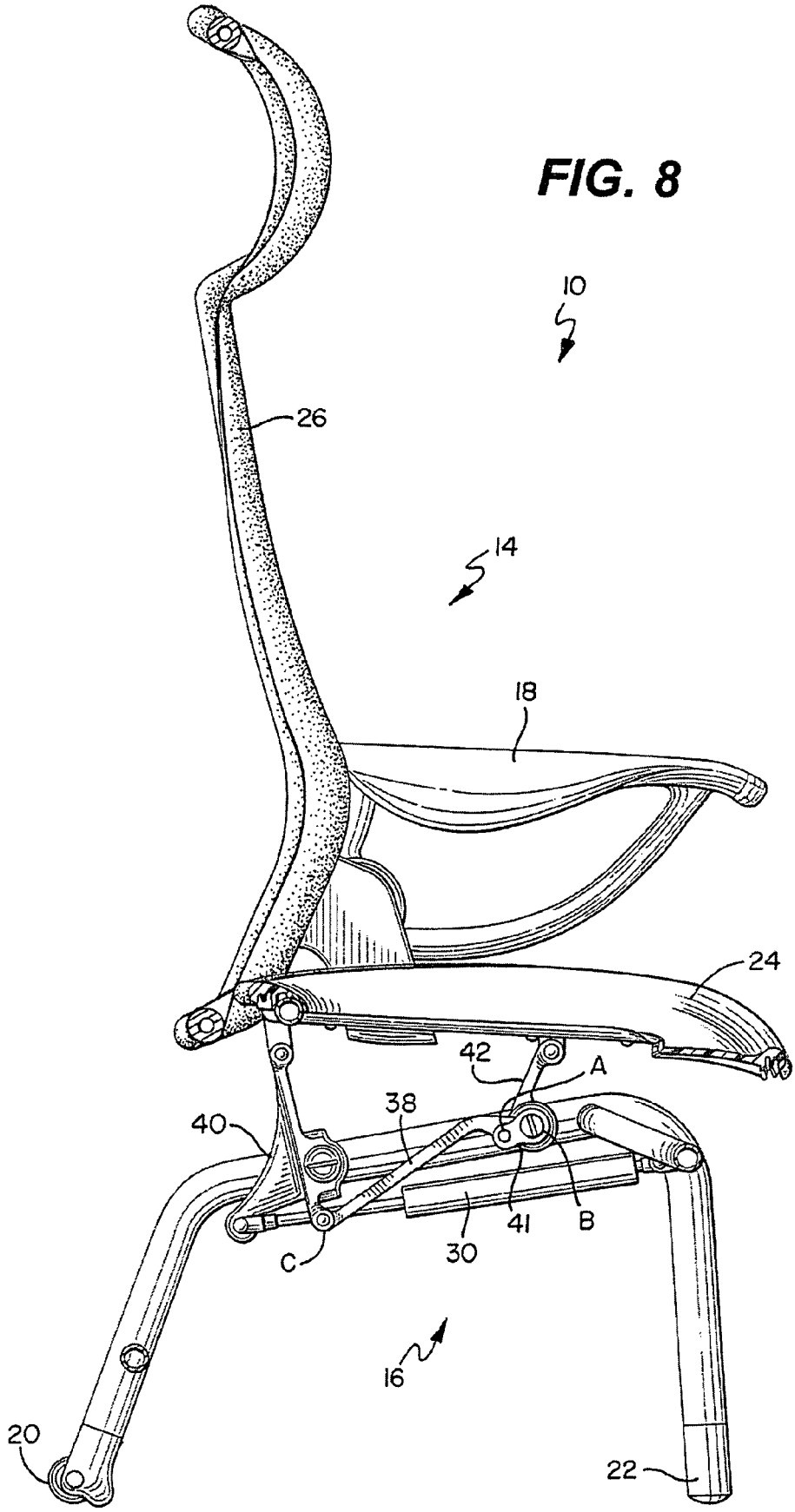
FIG. 8 is a cross-section side view of the chair shown in FIG. 1, wherein the seat is in the second position shown in FIG. 4.

FIG. 7 shows the various components of the lift assist mechanism 16 in cross section when the seating portion 14 is in the first position. FIG. 8 shows the various components of the lift assist mechanism 16 in cross section when the seating portion 14 is in the second position. As shown in FIGS. 7 and 8, there are three axis that are important to the operation of the over-center locking mechanism: axis A, the axis on which the over-center locking arm 38 joins the rotating mounting bar 41; axis B, the axis through the front cross bar 39 about which the mounting bar 41 rotates; and axis C, the axis on which the over-center locking arm 38 joins a pivoting rear seating mount 40. The combination of the over-center locking mechanism, the pivoting rear seating mount 40 and a pair of pivoting front seating mounts 42 enables the seating portion 14 to be repositioned between the first and second positions described above.

Figure 3:
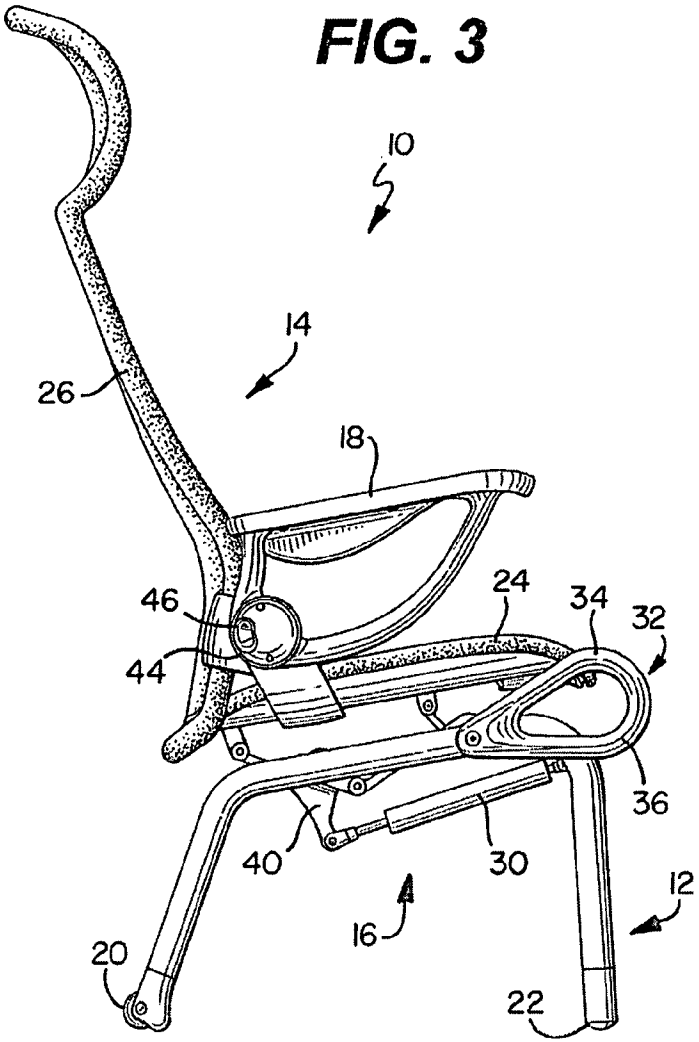
FIG. 3 is a side view of the chair shown in FIG. 1, wherein the seat and arm are both in a first position, respectively.
Figure 5:
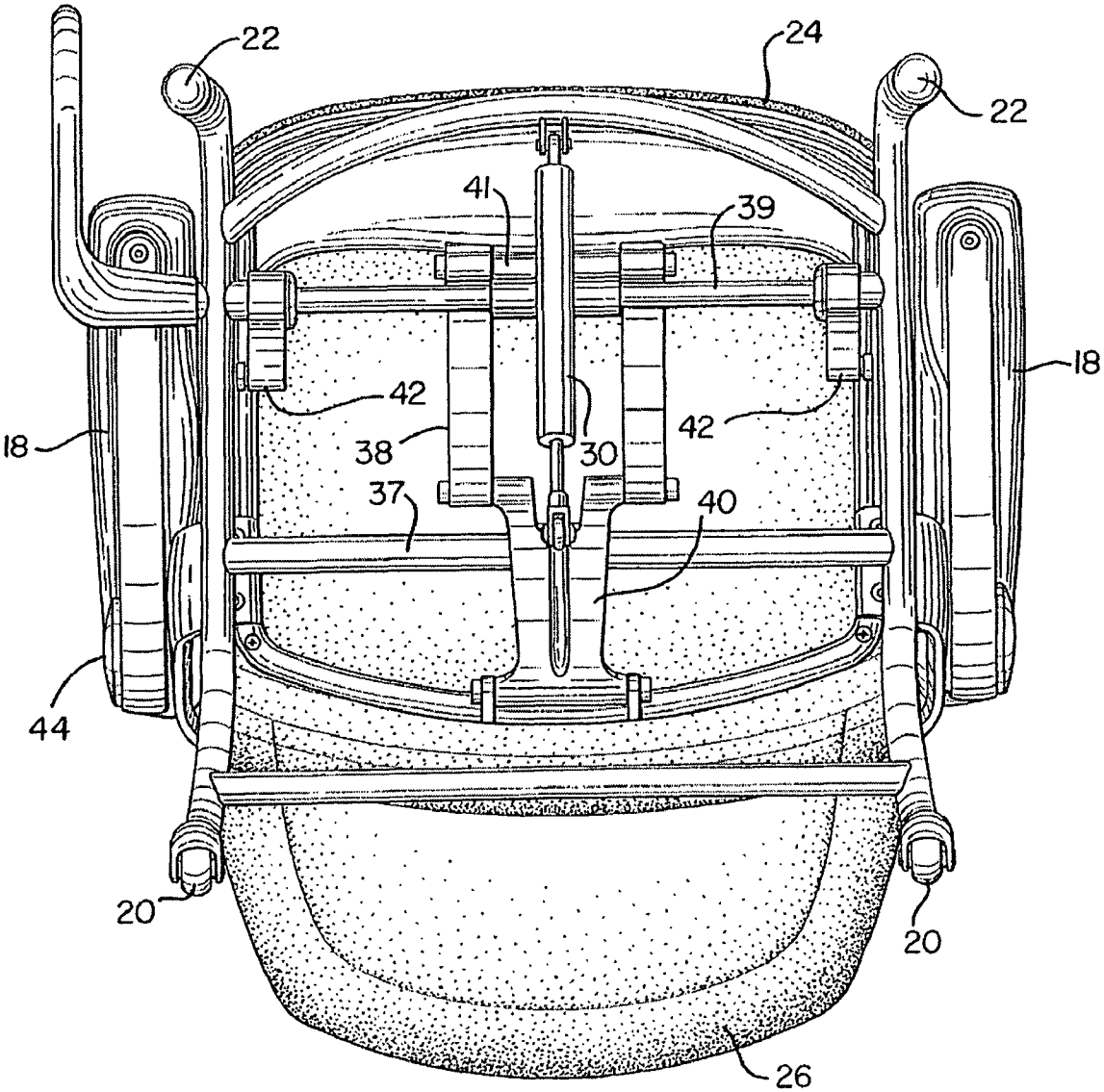
FIG. 5 is a bottom view of the chair shown in FIG. 1, wherein the seat and arm are both in a first position shown in FIG. 3.

As described above, the lift assist mechanism 16 illustrated in the FIGS. enables a user sitting in the chair 10 to rotate the handle 34 backwards to place the seating portion 14 in its first position as shown in FIG. 3. As shown in FIGS. 5-8, the rotation of the handle 34 in turn rotates the mounting bar 41, which is hingedly connected to the over-center locking arm 38 along axis A, in the opposite rotational direction of the handle 34. This movement is important to the operation of the over-center locking mechanism. Due to the orientation of the components, as well as the inclusion of the spring 30, a compression force is generated within the various components of the over-center locking mechanism. When axis A, axis B and axis C are all contained in a single plane, the compressive force is highest. When axis B passes "over-center" of the line between axis A and axis C in either direction, the compression force lowers. Accordingly, once axis B has been rotated "over-center" in either direction, it will not spontaneously rotate back over-center the other direction without the user's assistance. Thus, when the handle 34 moves the seating portion 14 into either position, the seating portion 14 is "locked" into position, as shown in FIG. 7.

Figure 4:
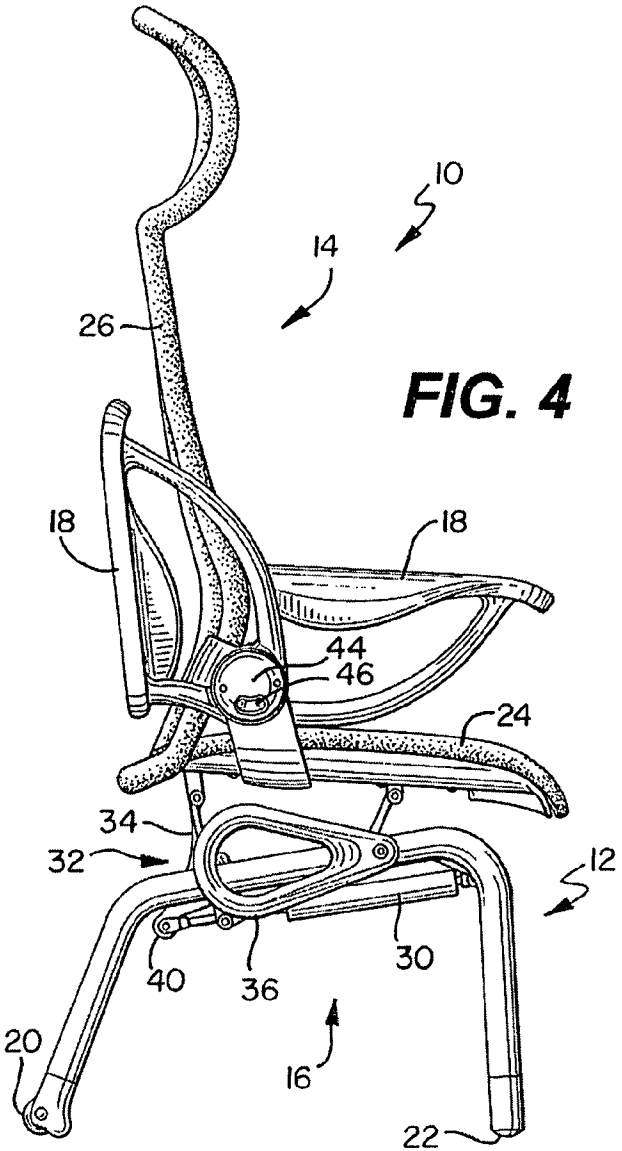
FIG. 4 is a side view of the chair shown in FIG. 1, where in the seat is inclined to a second position and the right arm is rotated into a second position.
Figure 6:
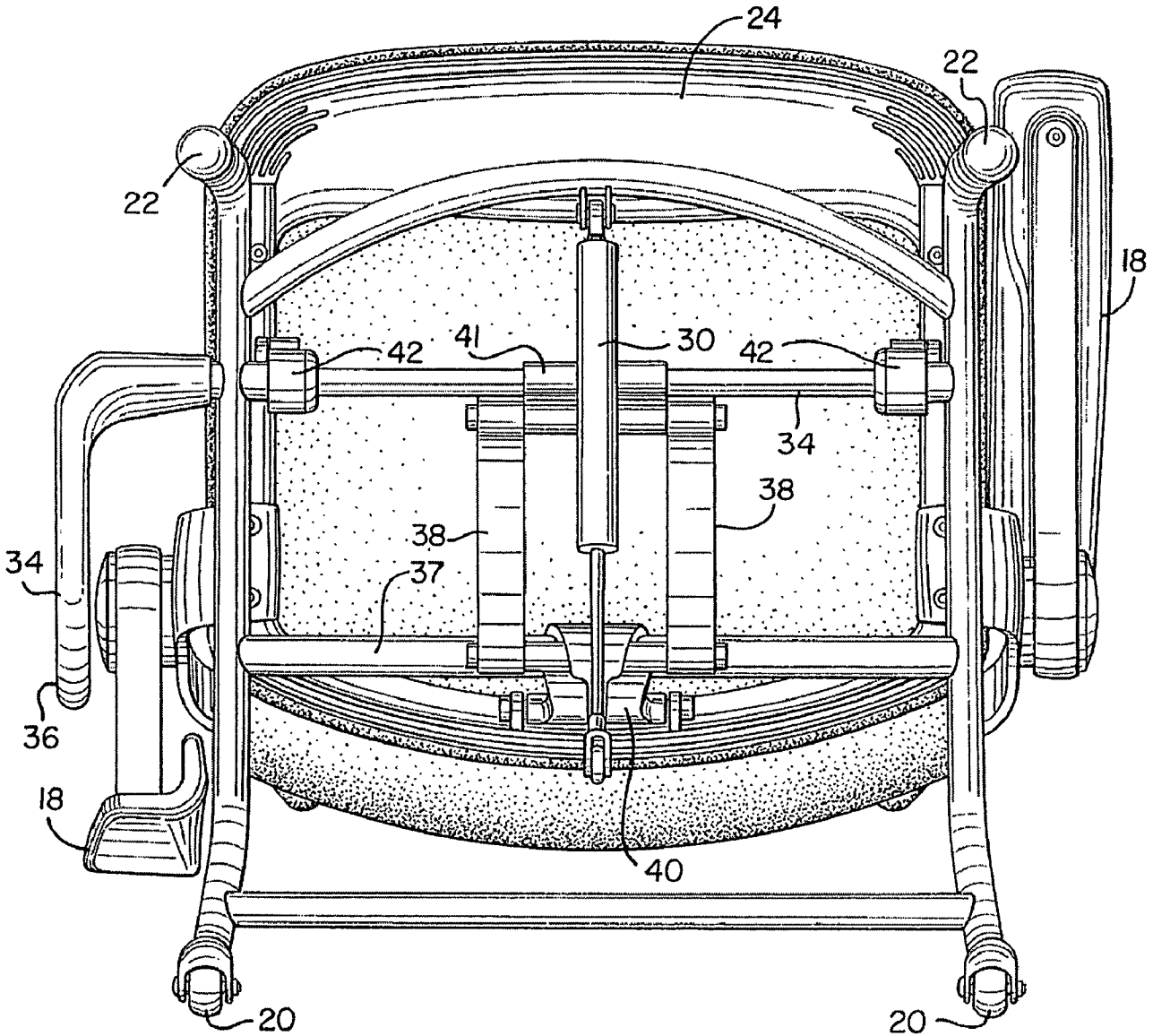
FIG. 6 is a bottom view of the chair shown in FIG. 1, wherein the seat and right arm are both in the second position shown in FIG. 4.

In the example shown in the FIGS., the spring 30 acts upon the pivoting rear seating mount 40 to bias the over-center locking mechanism towards the second position shown in FIGS. 4, 6 and 8. Thus, when the user rotates the handle 34 forwards, the spring 30 assists in pushing the seating portion 14 to the second inclined position shown in FIGS. 4, 6 and 8. When the user rotates the handle 34 backwards, the user must overcome the spring force to return the seating portion 14 to the first position. However, when a user sits into the chair 10, the weight of the user assists in compressing the spring 30, thereby enabling a user to more easily manipulate the chair 10 into the first position, even for those users without great upper body strength.

Some of the benefits of the over-center locking mechanism of the lift assist mechanism 16 are: (a) strong locking forces are generated without excessive user forces due to the gear effects based on the size of the handle 34 and the size of the rotating mounting bar 41; (b) the over-center locking mechanism gives the user tactile feedback as to whether the mechanism is locked; (c) the forces required to operate the over-center locking mechanism can be altered by modifying the components to match the desired actions and reactions; (d) the relatively large motion of the seating portion 14 from the first to second positions can be achieved with a relatively short motion of the handle 34; (e) most users will be able to lock the over-center locking mechanism with one hand.

As further shown in FIG. 1, the adjustable arms 18 are attached to the seating portion 14 of the chair 10. Although this configuration is helpful in keeping consistency in orientation between the adjustable arms 18 and the seating portion 14, it is understood that other configurations, such as, for example, attaching the adjustable arms 18 to the base 12 may be preferable for other purposes. As shown, the adjustable arms 18 each may rotate between a first "lowered" position shown in FIG. 3 and a second "raised" position shown in FIG. 5. The rotation of the adjustable arms 18 occurs around a pivot 44 where the adjustable arms 18 attach to the seating portion 14. The pivot 44 includes a defeatable lock 46 to maintain the adjustable arms 18 in either the lowered or raised position, regardless of the position of the seating portion 14. The defeatable lock 46 shown in the Figs. holds the adjustable arms 18 in position and is "defeated," in other words the locking mechanism is released, when the user depresses a button in the lock 46. The button in the lock 46 is a spring loaded button that mates with a corresponding locking hole in the lock 46. Thus, the arms can be adjusted between positions, locked in place and easily unlocked by a user. The adjustable arms 18 allow the user to reach outside of the chair 10 for additional support or enable another person to assist the user of the chair 10 in sitting down or standing up from the chair 10. Additionally, as shown in FIG. 4, when the one or both of the arms 18 are raised, and the seating portion 14 is inclined, the arms 18 are completely out of the way to allow another person, such as a caregiver, to assist the user of the chair in getting into or out of the chair 10.

It should be noted that various changes and modifications to the presently preferred embodiments described herein will be apparent to those skilled in the art. Such changes and modifications may be made without departing from the spirit and scope of the present invention and without diminishing its attendant advantages.

We claim:

1. A chair comprising:

a base;

a seating portion attached to the base via a lift assist mechanism that assists in moving the seating portion from a first reclined position to a second inclined position without electrical power, wherein the lift assist mechanism includes an over-center locking mechanism that locks the seating portion in at least one of the first reclined position and the second inclined position, wherein the over-center locking mechanism comprises a first link rotating about a first fixed axis and a locking arm pivotally connected to said first link about a second axis, wherein the locking arm is pivotal about a third axis, wherein the first fixed axis is positioned closer to the third axis than the second axis when the seating portion is positioned in the first reclined position and wherein the second axis is positioned closer to the third axis than the first fixed axis when the seating portion is positioned in the second inclined position.

2. The chair of claim 1 wherein the base includes four legs, two of which include rolling castors.

3. The chair of claim 2 wherein the remaining two legs include stoppers preventing unwanted movement of the chair when in use.

4. The chair of claim 1 further comprising a back portion connected to the base that moves in connection with the seating portion.

5. The chair of claim 1 wherein the first reclined position is approximately 10 degrees from horizontal.

6. The chair of claim 1 wherein the second inclined position is approximately 3 degrees from horizontal.

7. The chair of claim 1 further including moveable arms attached to the seating portion that rotate between a first arm position and a second arm position, wherein the first and second arm positions are lockable in each of the first and second positions.

8. The chair of claim 1 wherein the over-center locking mechanism includes an activator.

9. The chair of claim 8 wherein the activator locks when the seating portion is in the first reclined position and assists in moving the seating portion to the second inclined position.

10. The chair of claim 9 wherein the activator is a gas spring.

11. The chair of claim 1 wherein the first, second and third axes are contained in a single plane when the seating portion is in the first reclined position and in the second inclined position.

12. The chair of claim 1 wherein the lift assist mechanism comprises a second link pivotally coupled to the seating portion about a fourth pivot axis and pivotally coupled to the base about the first pivot axis, and a third link pivotally coupled to the seating portion about a fifth pivot axis, and pivotally coupled to the locking arm about the third pivot axis.

13. The chair of claim 12 wherein said third link is pivotally coupled to the base about a sixth pivot axis.

14. A chair comprising:

a seating portion adjustable between two positions, including a first reclined position and a second inclined position, wherein the seating portion is adjustably supported by a first link pivotally coupled to a base about a first pivot axis;

an over-center locking mechanism including an activator that locks when the seating portion is in the first reclined position, and that assists in transitioning the seating portion to the second inclined position, wherein said over-center locking mechanism comprises a locking arm pivotally coupled to a second link about a second pivot axis, wherein the second link is pivotally coupled to the base about the first pivot axis, wherein the locking arm and second link are moveable between first and second locking positions as the seating portion is moved between the first reclined position and the second inclined position.

15. The chair of claim 14 wherein the first reclined position is approximately 10 degrees from horizontal.

16. The chair of claim 14 wherein the second inclined position is approximately 3 degrees from horizontal.

17. The chair of claim 11 wherein the spring is a gas spring.

18. The chair of claim 14 further comprising a back portion that moves in connection with the seating portion.

19. A chair comprising:

a seating portion adjustable between first and second seating positions;

an over-center locking mechanism controlling the adjustment of the seating portion between the first and second seating positions, wherein the over-center locking mechanism comprises a link pivotally coupled to a base about a first fixed axis and a locking arm pivotally coupled to the link about a second axis; and a control lever comprising a grippable portion, wherein the control lever is fixedly and non-rotatably coupled to the link, the control lever is pivotally coupled to the base about the first fixed axis, and the control lever is pivotable relative to the seating portion, wherein the control lever is manually rotatable by a user between a first control position and a second control position corresponding to the first and second seating positions, wherein the locking arm is moveable between first and second locking positions in response to the movement of the control lever between the first and second control positions.

20. The chair of claim 19 further comprising a back portion that moves in connection with the seating portion.

21. The chair of claim 19 wherein the over-center locking mechanism includes a gas spring activator.

22. The chair of claim 19 wherein the first and second seating positions include an approximately ten degree reclined position and an approximately three degree inclined position.

23. The chair of claim 19 wherein the over-center locking mechanism locks the seating portion in one of the first and second positions.

24. The chair of claim 19 wherein the control lever is fixedly connected to the link with a cross bar.

25. The chair of claim 19 wherein the grippable portion comprises a looped portion.

* * * * *